US012349805B2

(12) United States Patent
Serena et al.

(10) Patent No.: US 12,349,805 B2
(45) Date of Patent: Jul. 8, 2025

(54) ADJUSTMENT DEVICE FOR A CHAIR WITH OSCILLATING MECHANISM

(71) Applicant: BRADO S.P.A., Valdobbiadene (IT)

(72) Inventors: Stefano Serena, Caerano di San Marco (IT); Trevor Robert Hollard, Eggenfelden (DE)

(73) Assignee: BRADO S.P.A., Frazione Bigolino (IT)

( * ) Notice: Subject to any disclaimer, the term of this patent is extended or adjusted under 35 U.S.C. 154(b) by 142 days.

(21) Appl. No.: 18/144,510

(22) Filed: May 8, 2023

(65) Prior Publication Data

US 2023/0363536 A1 Nov. 16, 2023

(30) Foreign Application Priority Data

May 10, 2022 (IT) ..... 102022000009566

(51) Int. Cl.

| | |
|---|---|
| ***A47C 1/032*** | (2006.01) |
| ***A47C 1/033*** | (2006.01) |
| ***A47C 3/02*** | (2006.01) |
| ***A47C 3/025*** | (2006.01) |
| ***A47C 3/026*** | (2006.01) |
| ***A47C 3/30*** | (2006.01) |
| ***A47C 7/44*** | (2006.01) |

(52) U.S. Cl.

CPC ..... *A47C 3/0255* (2013.01); *A47C 1/03283* (2013.01); *A47C 3/026* (2013.01); *A47C 3/30* (2013.01); *A47C 7/446* (2013.01)

(58) Field of Classification Search

CPC ..... A47C 1/03283; A47C 3/026; A47C 7/446; A47C 3/0255; A47C 3/30

USPC ..... 297/300.3, 301.2, 302.2, 303.2

See application file for complete search history.

(56) References Cited

U.S. PATENT DOCUMENTS 4,432,582 A * 2/1984 Wiesmann ..... A47C 1/03255 297/300.3 X
4,948,198 A * 8/1990 Crossman ..... A47C 7/441 297/303.4
4,966,411 A * 10/1990 Katagiri ..... A47C 31/126 297/300.3 X (Continued)

FOREIGN PATENT DOCUMENTS

EP 2046165 A1 4/2009
WO 2008/000295 A1 1/2008

(Continued)

OTHER PUBLICATIONS

Italian Search Report and Written Opinion dated Dec. 7, 2022 issued in IT 202200009566, with partial translation.

*Primary Examiner* — Rodney B White

(74) *Attorney, Agent, or Firm* — Scully, Scott, Murphy & Presser, P.C.

(57) ABSTRACT

An adjustment device for a chair with an oscillating mechanism having a first plate, connected to a central gas-operated post for height adjustment of a seat, to which a second plate, fixed to a backrest, is articulated so that the second plate can oscillate by means of a first pivot, wherein a third plate is articulated and interposed, respectively by means of a second pivot and a third pivot, between said first plate and said second plate, and is configured to be connected to said seat, said first plate having means for connection to at least one slat or leaf spring which is adapted to contrast to an inclination of said second plate with respect to said first plate.

10 Claims, 13 Drawing Sheets

(56) References Cited

U.S. PATENT DOCUMENTS 5,228,748 A * 7/1993 Neumuller ..... A47C 1/03294 297/300.1
5,348,371 A * 9/1994 Miotto ..... A47C 1/0325 297/303.2
5,447,357 A * 9/1995 Dauphin ..... A47C 1/03283 297/301.4
5,573,303 A * 11/1996 Doerner ..... A47C 1/03272 297/319
5,658,045 A * 8/1997 Van Koolwijk ... A47C 1/03274 297/301.7
5,664,834 A * 9/1997 Hsu ..... A47C 1/03266 297/301.1
5,725,276 A * 3/1998 Ginat ..... A47C 1/03255 297/301.4
5,918,935 A * 7/1999 Stulik ..... A47C 1/03266 297/301.4
6,033,020 A * 3/2000 Ito ..... A47C 7/444 297/328
6,120,096 A * 9/2000 Miotto ..... A47C 1/03255 297/301.4
6,419,320 B1 * 7/2002 Wang ..... A47C 1/03255 297/302.6
6,447,063 B1 * 9/2002 Beggs ..... A47C 1/03272 297/300.5
6,572,191 B2 * 6/2003 Wild ..... A47C 1/03283 297/301.4
7,614,697 B1 * 11/2009 Lai ..... A47C 1/03255 297/301.7
8,075,057 B2 * 12/2011 Reingewirtz ..... A47C 3/0251 297/313
10,231,545 B2 * 3/2019 Moreschi ..... A47C 3/0255
10,687,626 B2 * 6/2020 Yan ..... A47C 1/03255
10,813,458 B2 * 10/2020 Moreschi ..... A47C 7/58
11,344,122 B2 * 5/2022 Serena ..... A47C 7/285
2023/0363537 A1 * 11/2023 Serena ..... A47C 1/03255

FOREIGN PATENT DOCUMENTS

WO WO-2018154481 A1 * 8/2018 ..... A47C 1/03272
WO 2021/156672 A1 8/2021

* cited by examiner

ADJUSTMENT DEVICE FOR A CHAIR WITH OSCILLATING MECHANISM

The present invention relates to an adjustment device for a chair which is provided with an oscillating mechanism.

Nowadays it is known to provide chairs that are fitted with a mechanism the function of which is to enable for example the height adjustment of a seat and the adjustment of the oscillation, or the locking in place, of a backrest.

An example of the mentioned prior art is disclosed in U.S. Pat. No. 6,120,096, where the activation of the mechanisms which interact with the seat and with the backrest is performed by using a first lever, the rotation of which leads to the packing or not of special slats, and also a second lever, the lifting of which leads its terminal end to interact with a gas-filled piston present on a central gas-operated post.

The background art in this field involves the use of metal components that increase the rigidity of the system and which have increasingly high development and production costs.

In addition, the number of such components is high, which entails a long assembly time and an increase in the costs of investing in the construction of equipment for assembling the system.

The need to correlate the production of the various components to each specific design also imposes costs of investing in and adapting to the various types of chair seats and chair backrests.

Lastly, the overall volume of the oscillating mechanism is high, which results in a worsening of the aesthetic factor, as well as in high storage, packaging and transport costs.

The aim of the present invention is to solve the above mentioned technical problems, eliminating the drawbacks in the cited known art, by providing an adjustment device for a chair which is provided with an oscillating mechanism, which offers low development and production costs and at the same time is flexible for adaptation to personalized designs.

Within this aim, an object of the invention is to provide an oscillating mechanism that, applied to a chair, enables a controlled oscillation to be obtained in an optimal manner, and which can be adapted to various types of backrests.

Another object of the invention is to provide an adjustment device that requires less time for assembly and enables a saving in the investments relating to the construction of equipment for assembling it.

Another object of the invention is to obtain an adjustment device that has a limited number of parts inside it.

Another object of the invention is to provide an adjustment device that can be mounted on common seats or on customized seats.

Another object of the invention is to provide an adjustment device that is structurally simple and of low cost and can be made with the usual conventional systems.

The aim and these objects, as well as others which will become better evident hereinafter, are achieved by an adjustment device for a chair, comprising an oscillating mechanism composed of a first plate, associated with a central gas-operated post for the height adjustment of a seat, to which a second plate, fixed to a backrest, is articulated so that it can oscillate by means of a first pivot, characterized in that a third plate is articulated and interposed, respectively by means of a second pivot and a third pivot, between said first plate and said second plate, and can be associated with said seat, said first plate having means for connection to at least one slat or leaf spring which is adapted to elastically contrast the inclination of said second plate with respect to said first plate.

Further characteristics and advantages of the invention will be made clearer from the detailed description of a particular, but not exclusive, embodiment, illustrated by way of an indicative and non-limiting example in the enclosed drawings, in which.

Figure 1:
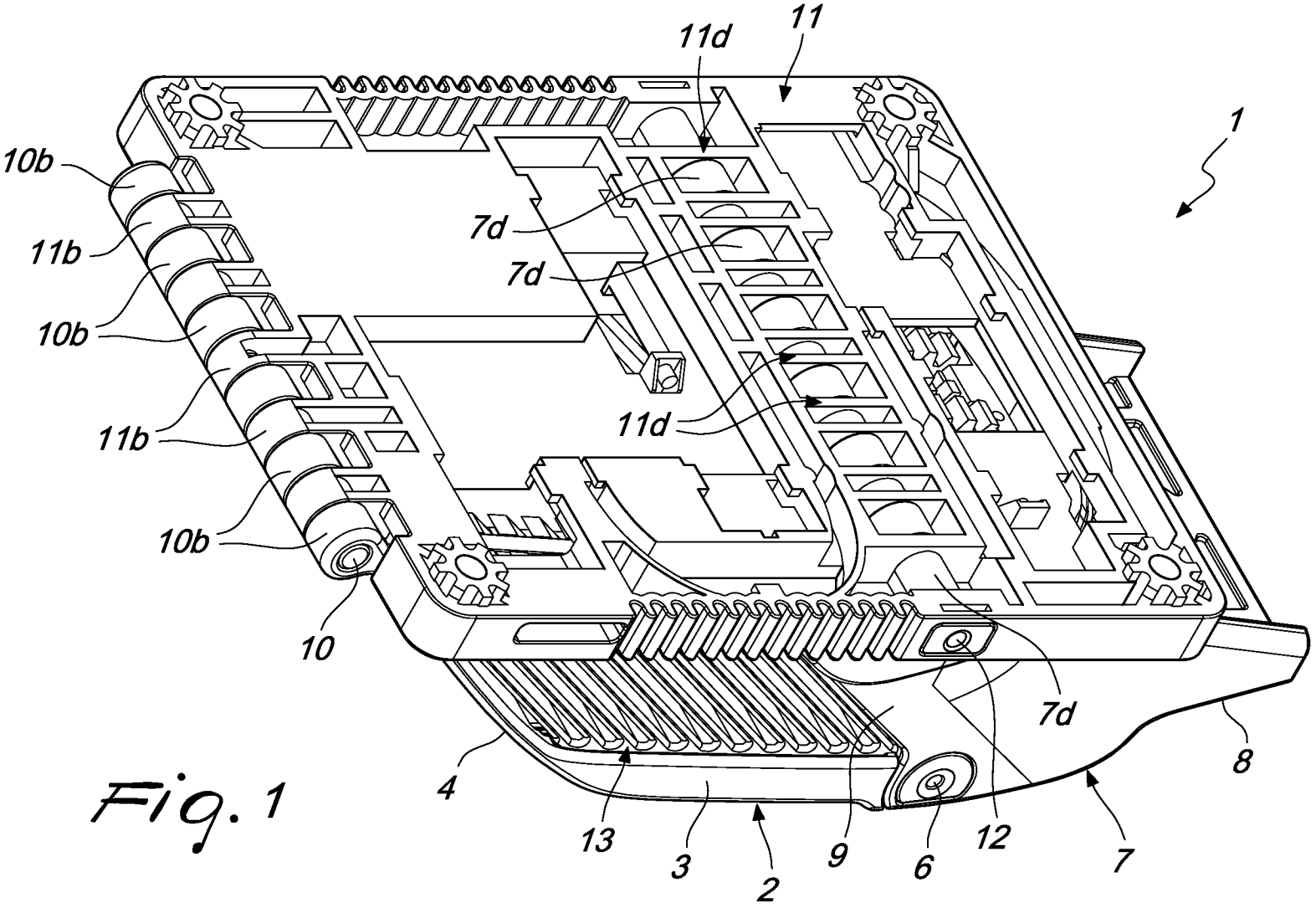
FIG. 1 is a three-quarter side view from above of the adjustment device according to the present invention.
Figure 2:
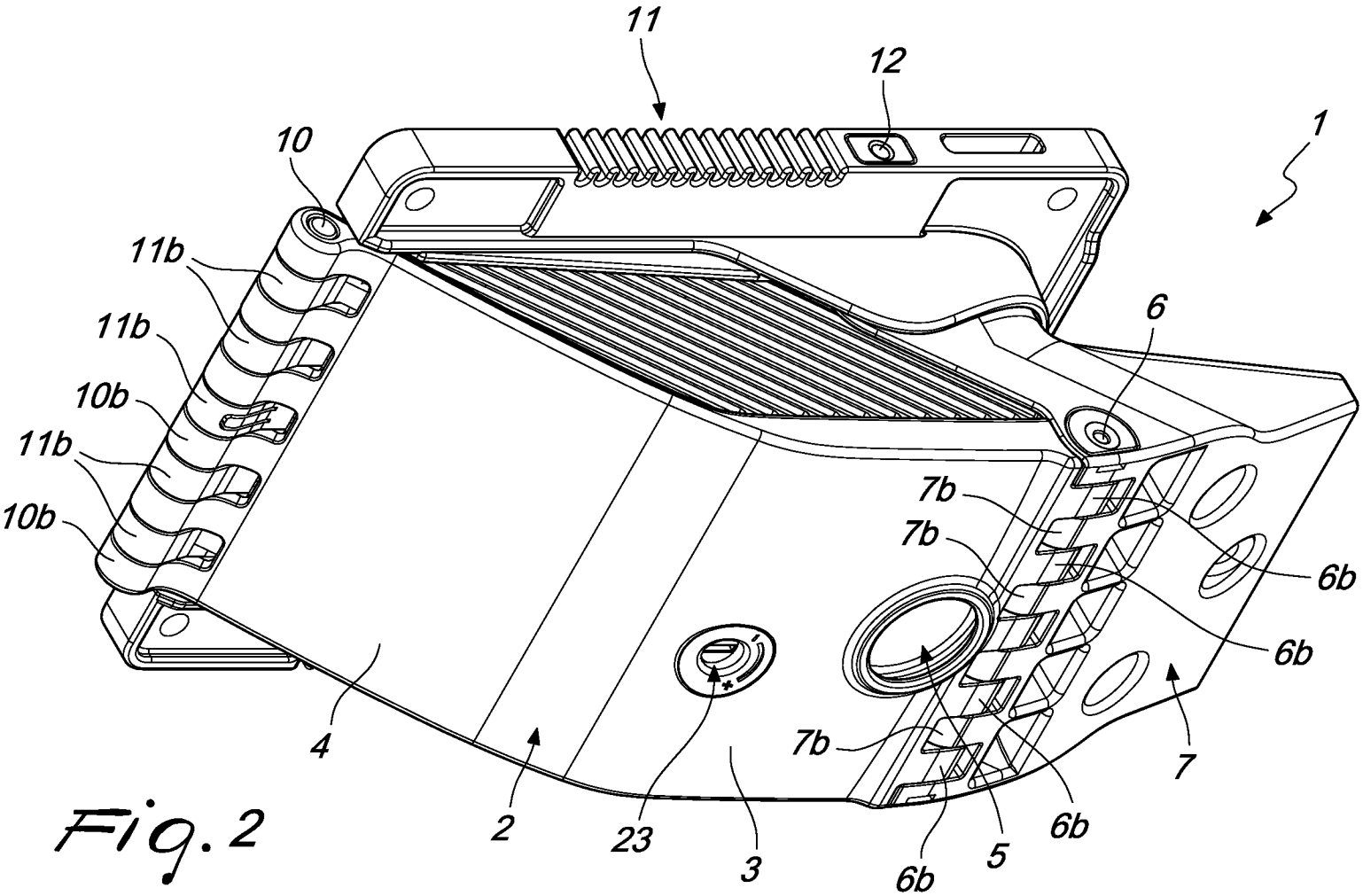
FIG. 2 is a three-quarter side view from below of the device according to the present invention.
Figure 3:
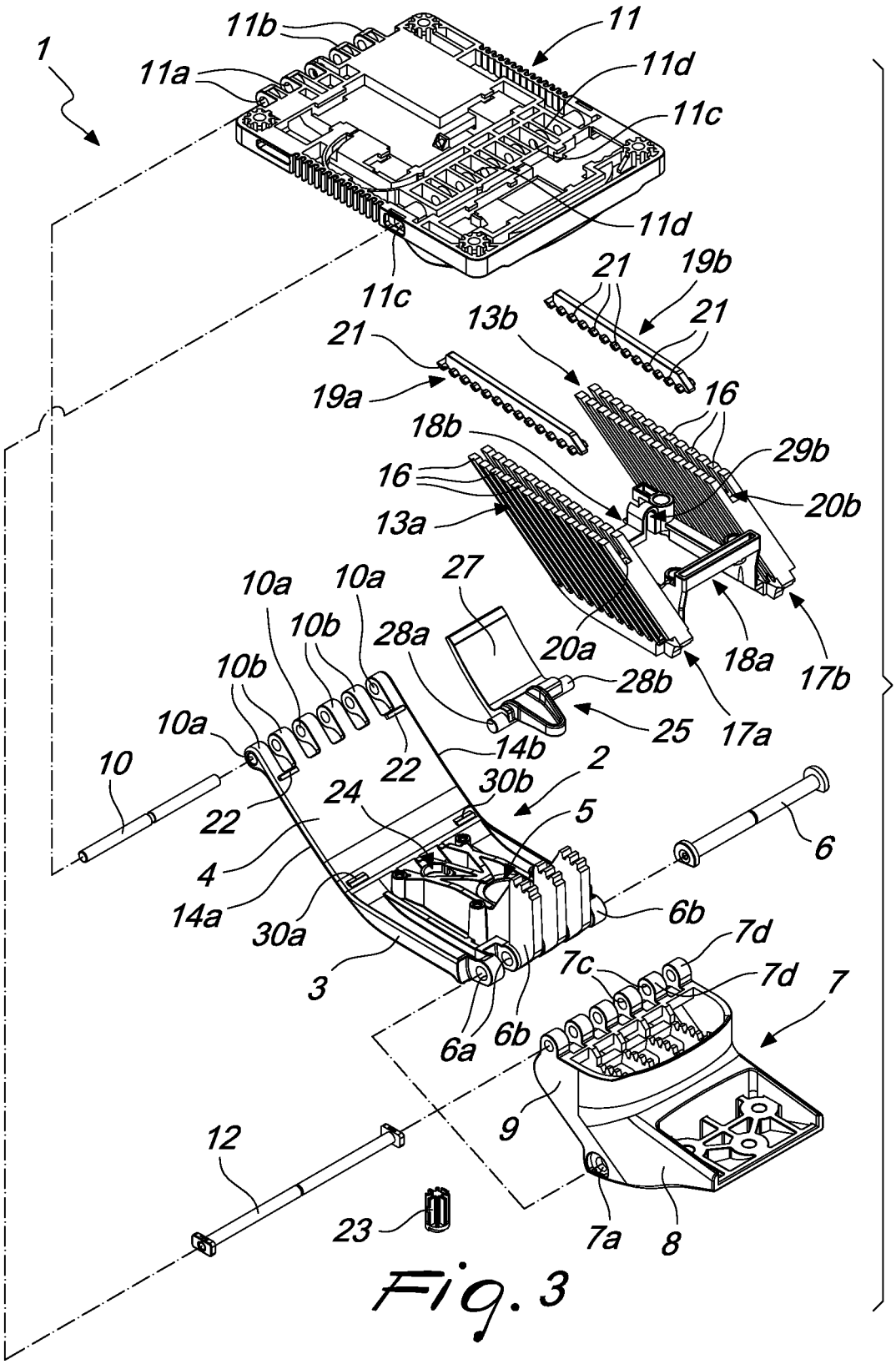
FIG. 3 is an exploded view of the device according to the present invention.
Figure 4:
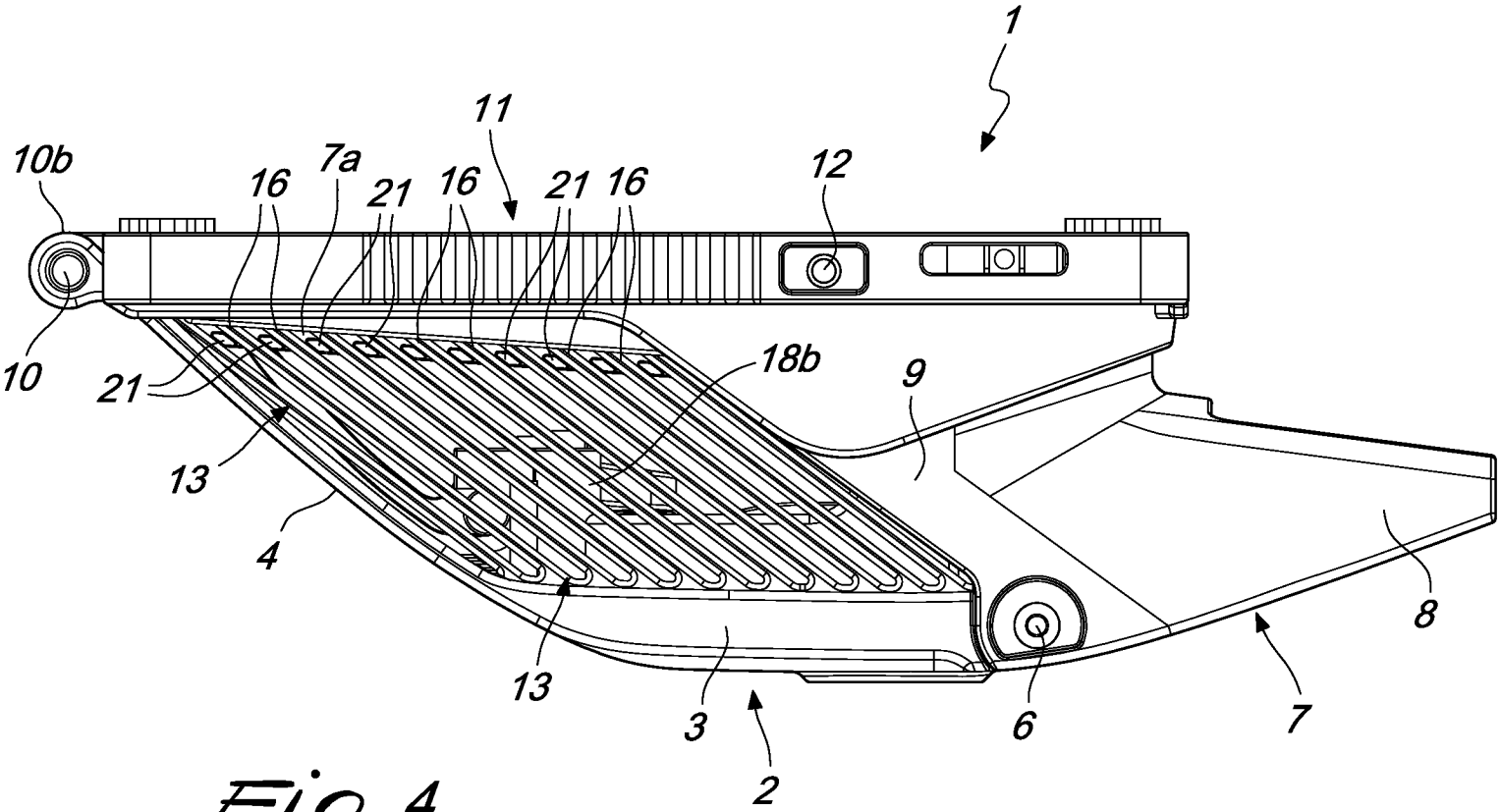
FIG. 4 is a side view of the device according to the present invention in the inactive condition.
Figure 5:
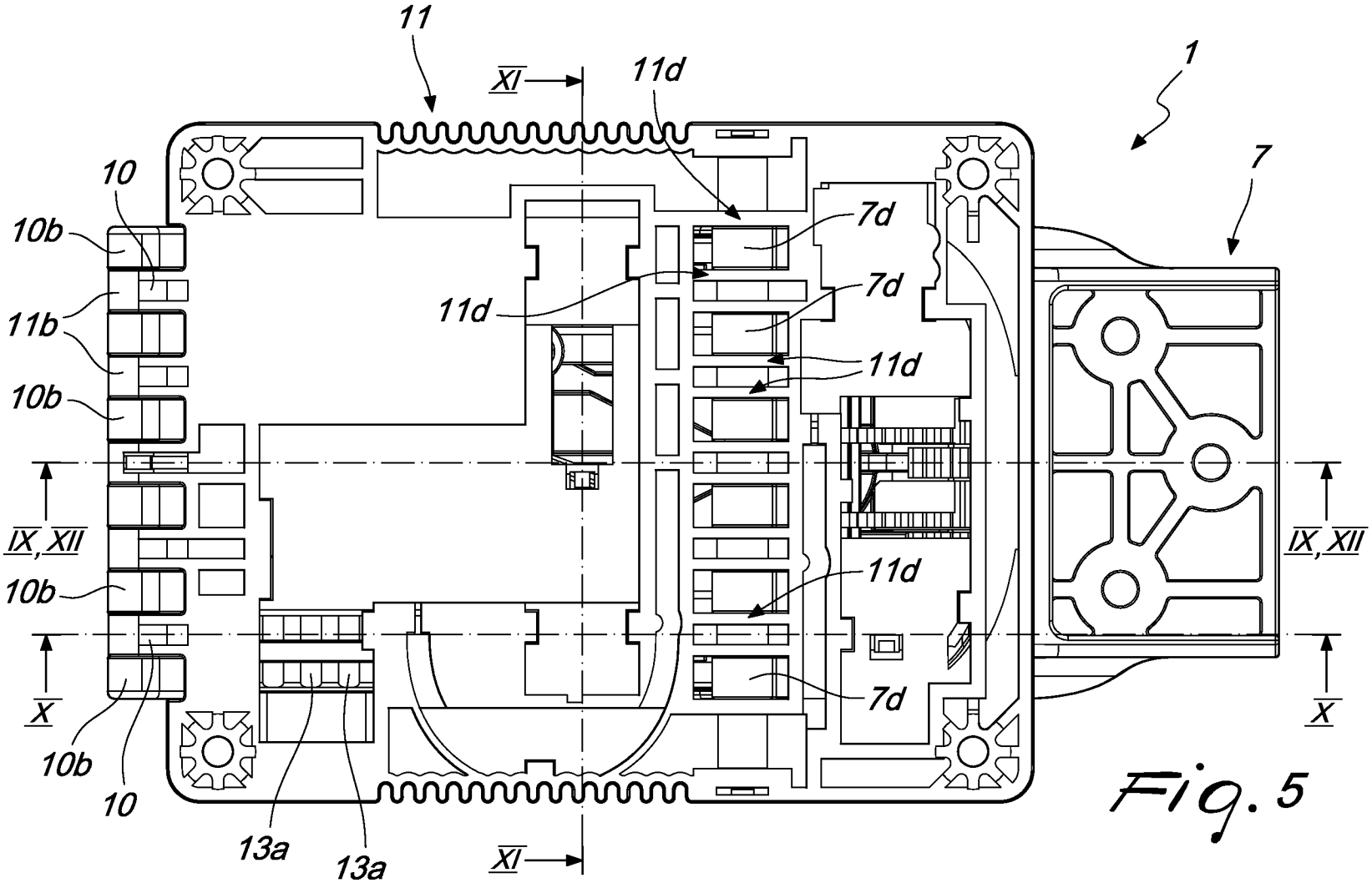
FIG. 5 is a view from above of the device according to the present invention.
Figure 6:
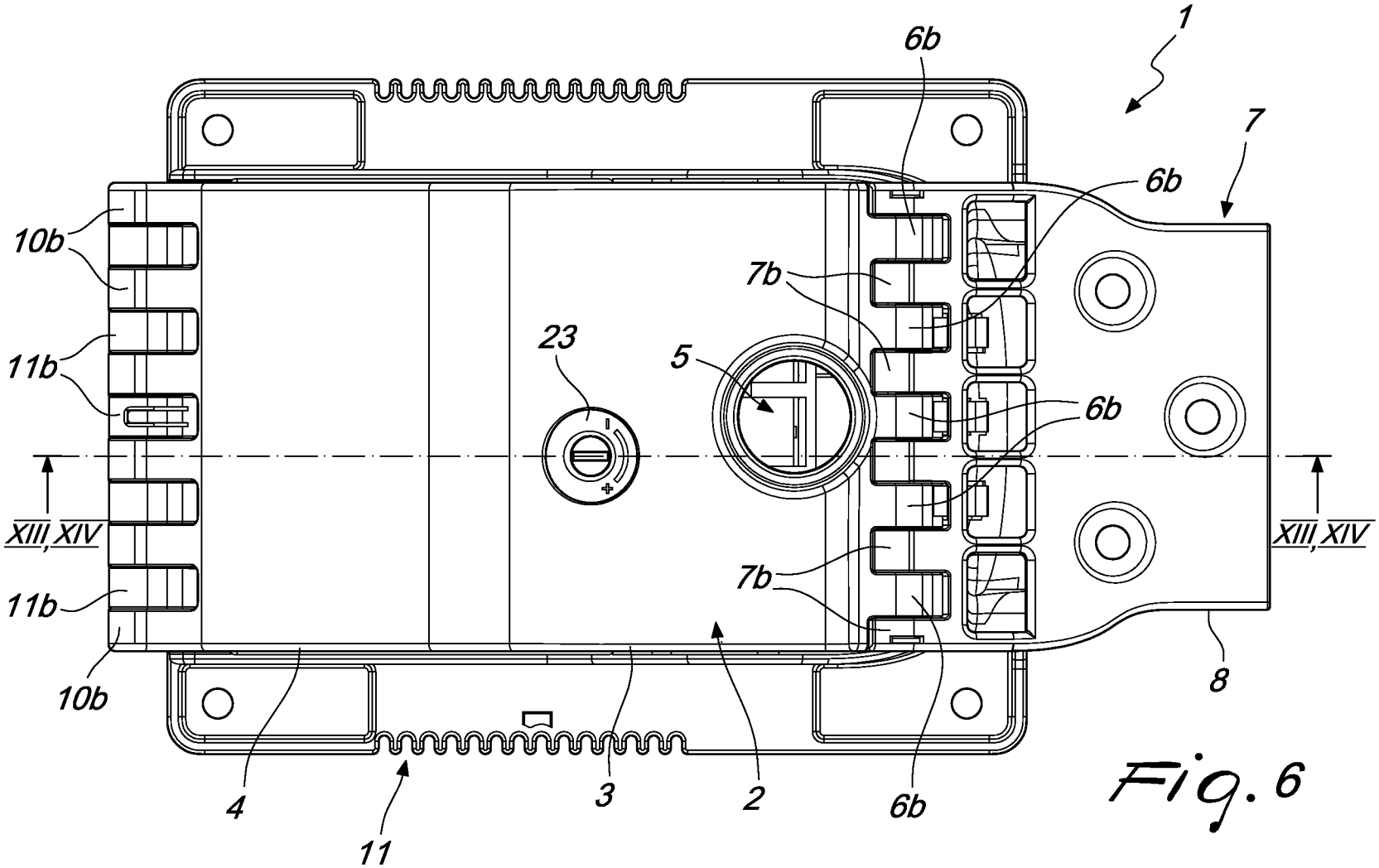
FIG. 6 is a view from below of the device according to the present invention.
Figure 7:
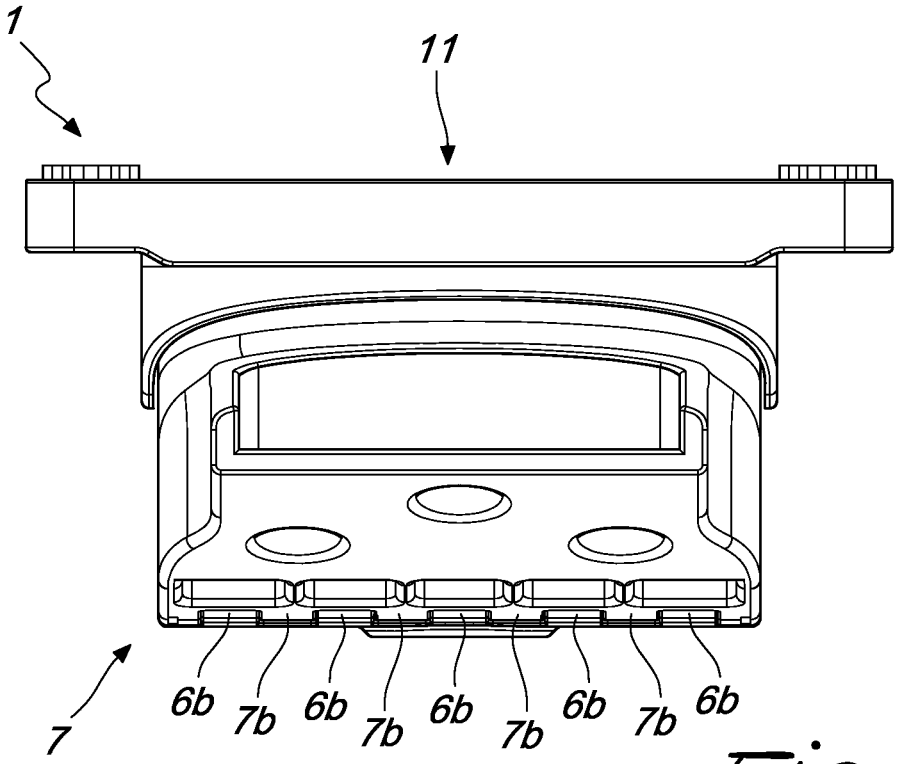
FIGS. 7 and 8 are front and rear elevation views of the device according to the present invention.
Figure 8:
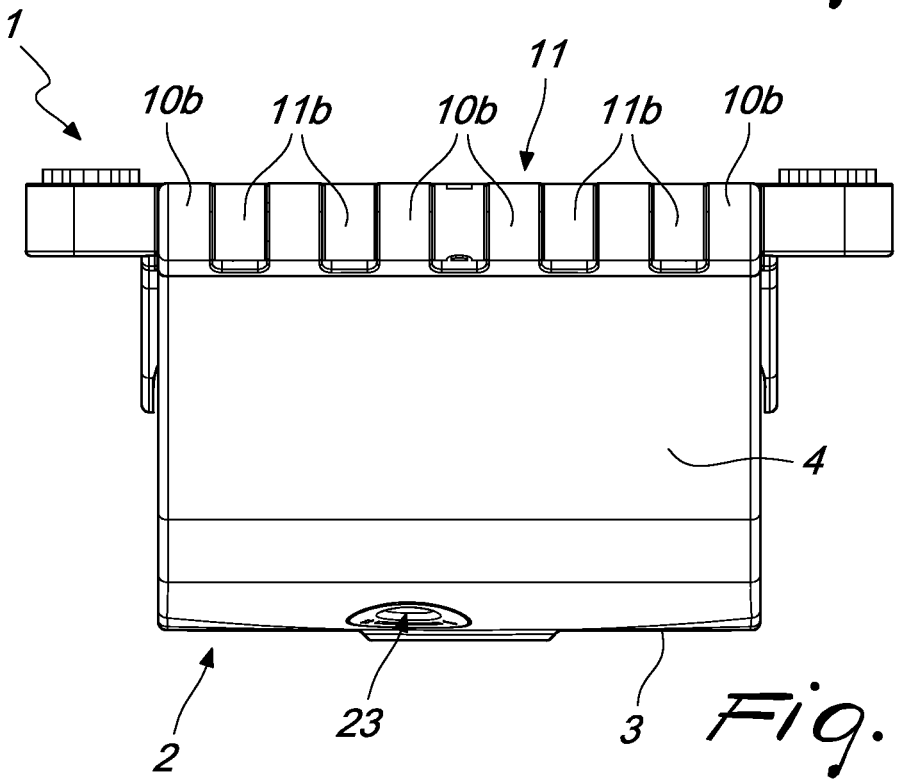
Figure 9:
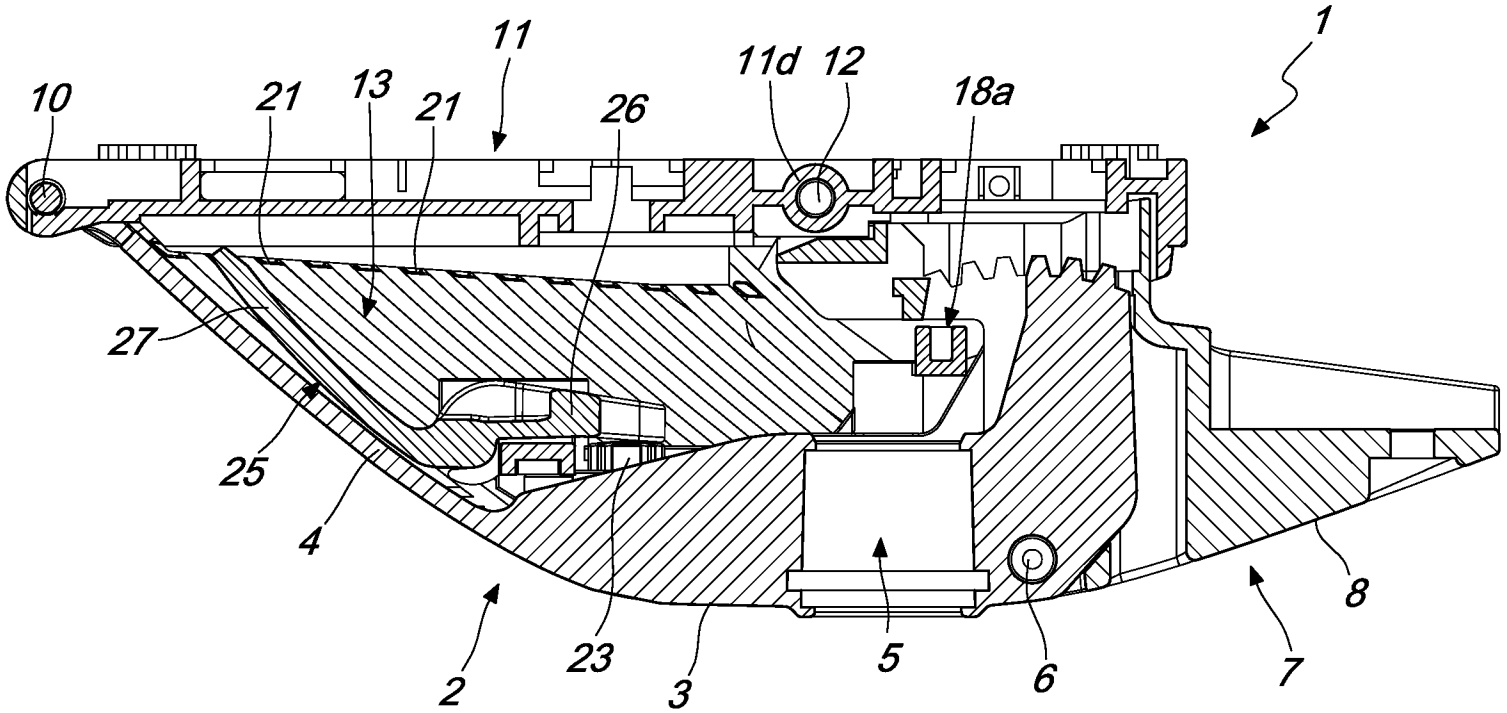
FIG. 9 is a cross-sectional view of the device according to the present invention taken along the line IX-IX of FIG. 5 in the condition in which it is not under load.
Figure 10:
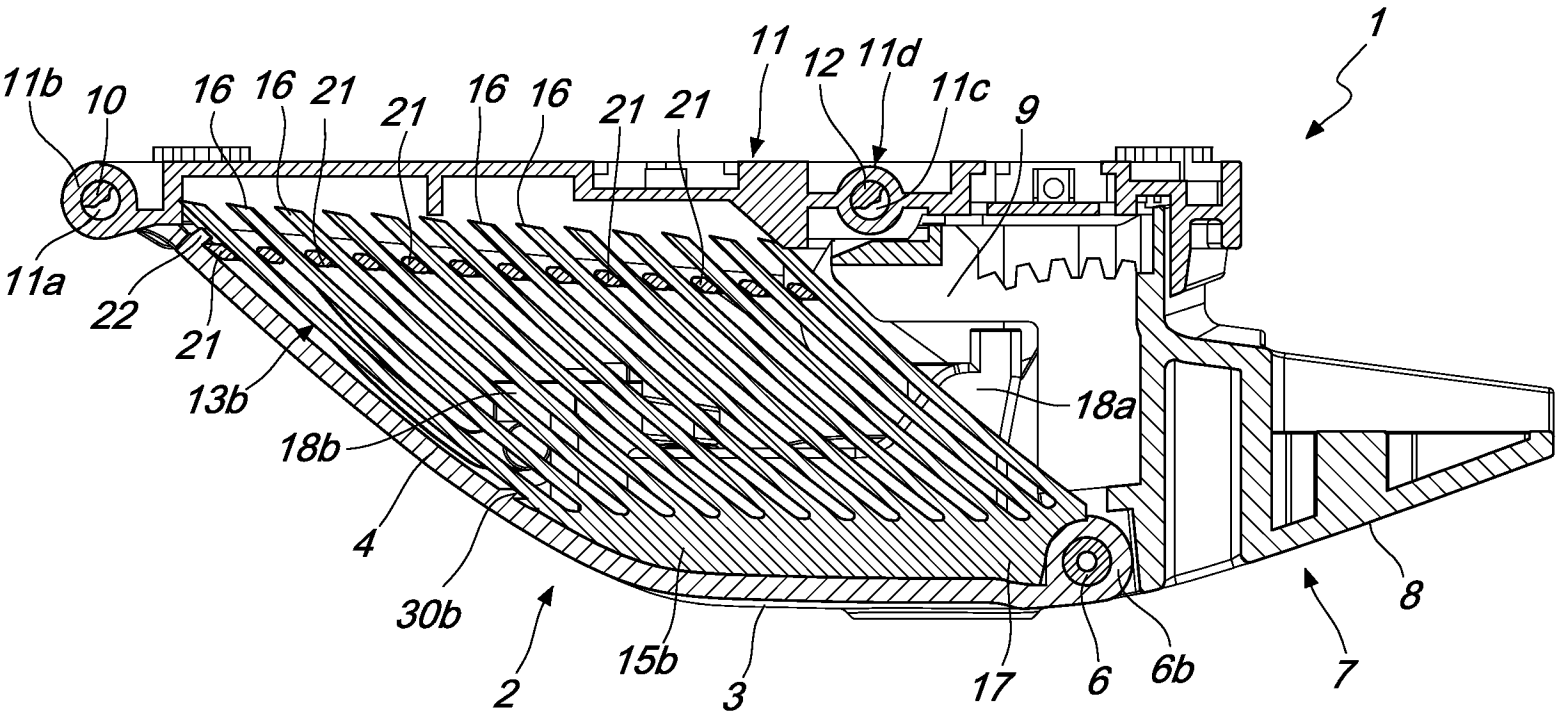
FIG. 10 is a cross-sectional view of the device according to the present invention taken along the line X-X of FIG. 5 in the condition in which it is not under load.
Figure 11:
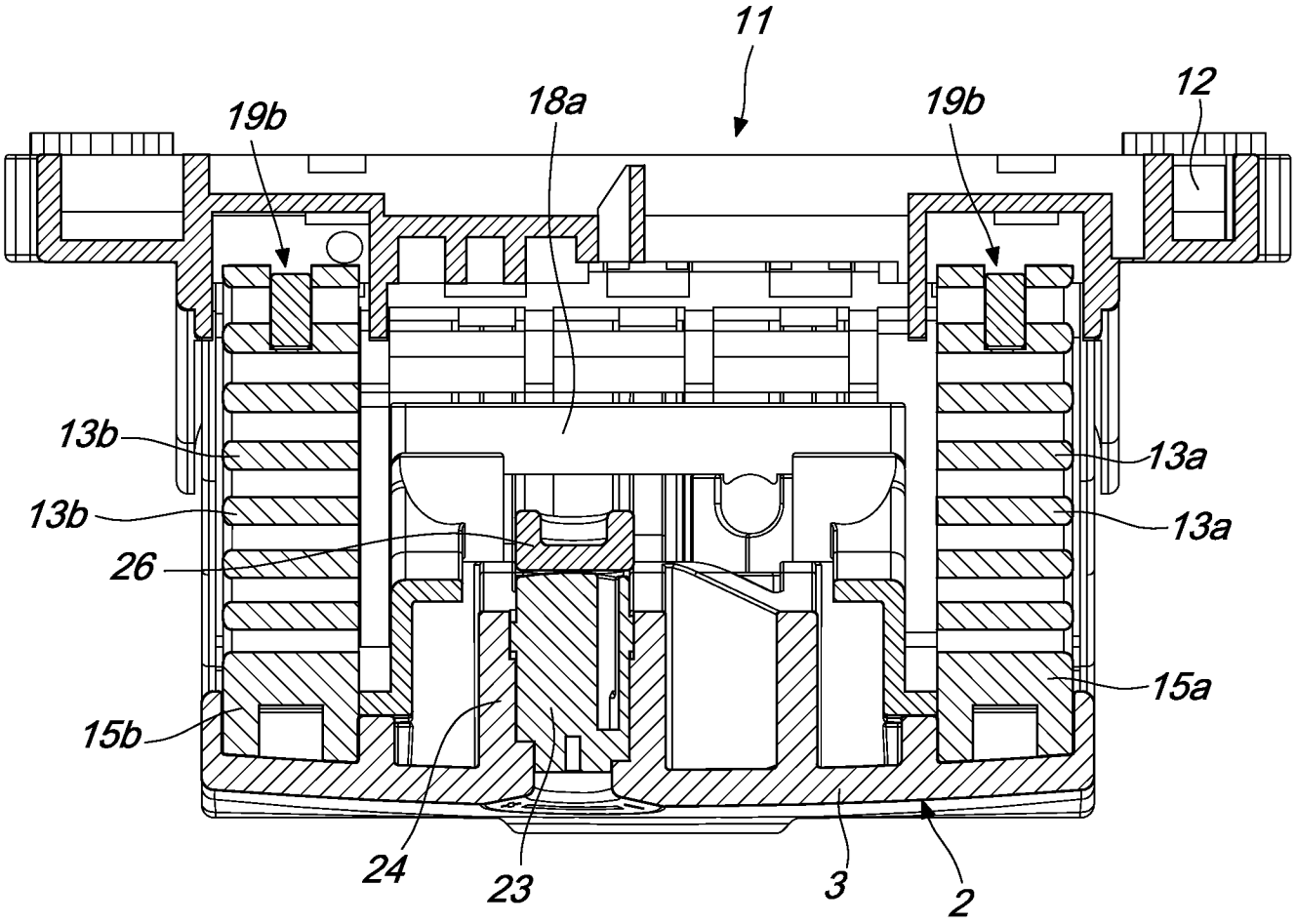
FIG. 11 is a cross-sectional view of the device according to the present invention taken along the line XI-XI of FIG. 5 in the condition in which it is not under load.

In the embodiments that follow, individual characteristics shown in relation to specific examples may in reality be interchanged with other, different characteristics, existing in other embodiments.

In addition, it should be noted that anything found to be already known during the patenting process is understood not to be claimed and to be the subject of a disclaimer.

With reference to the figures, the reference numeral 1 generally designates an adjustment device for a chair (not shown in its entirety) which comprises an oscillating mechanism composed of a substantially L-shaped first plate 2 which has a first wing 3 and a second wing 4.

At the first wing 3, there is a first bushing 5 which is associated with the end of the stem of a central gas-operated post, mounted on wheels and used for the height adjustment of a seat (not shown).

A second plate 7, which is also L-shaped to define a third wing 8 and a fourth wing 9, is transversely articulated to the terminal end of the first wing 3.

The articulation between the terminal end of the first wing 3 occurs substantially at the point of connection of the third wing and the fourth wing 8, 9 by means of the first pivot 6 arranged at adapted first receptacles 6*a*, 7*a* which are provided at adapted first slots 6*b*, 7*b* which are present on the free ends of the first wing 3 and at the point of connection of the third wing and the fourth wing 8, 9 of the second plate 7.

A backrest, conventional and not shown, can be associated with the third wing 8, by means of a special blade, also conventional and not shown.

The third plate 11 is articulated so that it can oscillate at the free end of the second wing 4, by means of a second pivot 10 which is arranged at adapted second receptacles 10*a*, 11*a* which are provided at adapted second slots 10*b*, 11*b* which are present on the free ends of the second wing 4 and the third plate 11.

The seat (not shown) can be associated above the third plate 11.

The third plate 11 is also articulated, proximate to the end that is opposite to the end of articulation to the second wing 4, at the free end of the fourth wing 9 of the second plate 7 by means of a third pivot 12 which is arranged at adapted third receptacles 11*c*, 7*c* which are provided at adapted partitions 11*d* and third slots 7*d* which are present on the third plate 11 and on the free end of the fourth wing 9 of the second plate 7.

The first plate 2 has means for connection to the at least one slat or leaf spring 13 which are adapted to elastically contrast the inclination of the second plate 7.

In the particular embodiment, two packs of slats or leaf springs 13*a*, 13*b* are considered, each one made of elastically deformable material, such as plastic material or metal, each one of the two packs of leaf springs 13*a*, 13*b* being constituted by single slats or flat springs which are arranged, when inactive, parallel to each other along a plane that is substantially parallel to the plane of arrangement of the second wing 4.

These two packs of slats or leaf springs 13*a*, 13*b* are arranged parallel to each other proximate to the lateral perimetral edges 14*a*, 14*b* of the second wing 4 and are connected in a lower region by two linear and rigid bases 15*a*, 15*b*, which can be positioned on the lateral perimetral edge 14*a*, 14*b* of the first wing 3.

Figure 12:
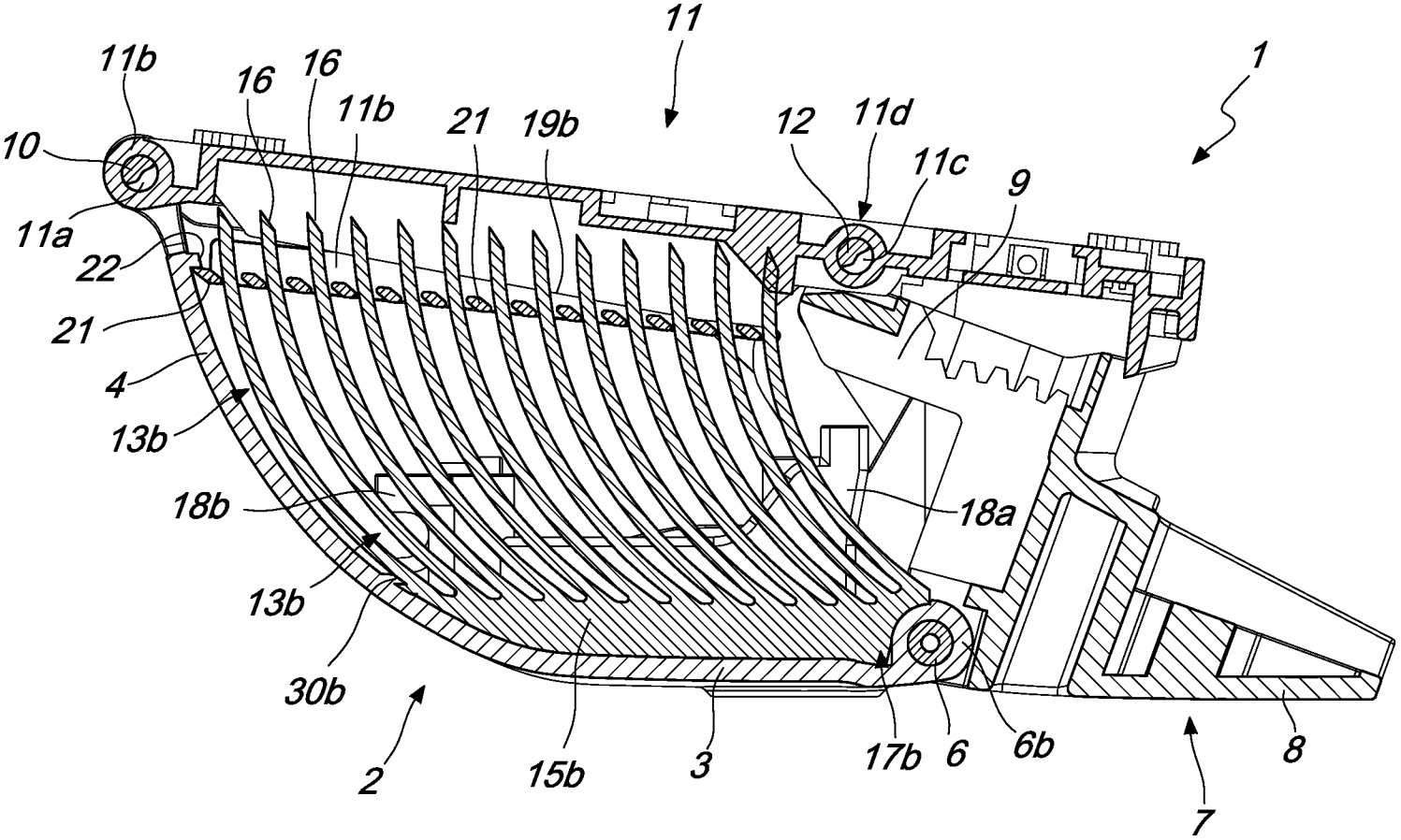
FIG. 12 is a cross-sectional view of the device according to the present invention taken along the line XII-XII of FIG. 5 in the condition in which it is under load.
Figure 13:
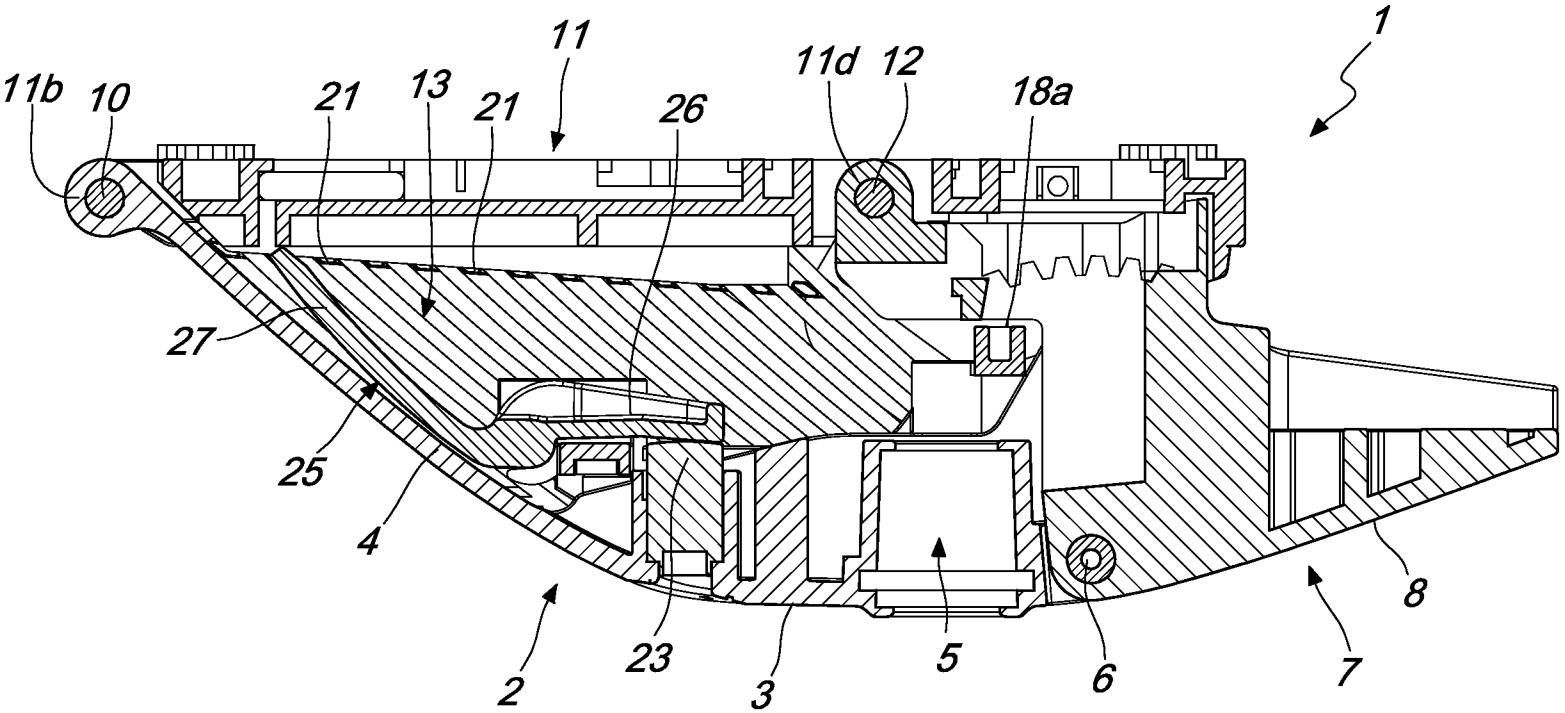
FIG. 13 is a cross-sectional view of the device according to the present invention taken along the line XIII-XIII of FIG. 6 wherein the second wing of the first plate is in the condition in which it is not under load.
Figure 14:
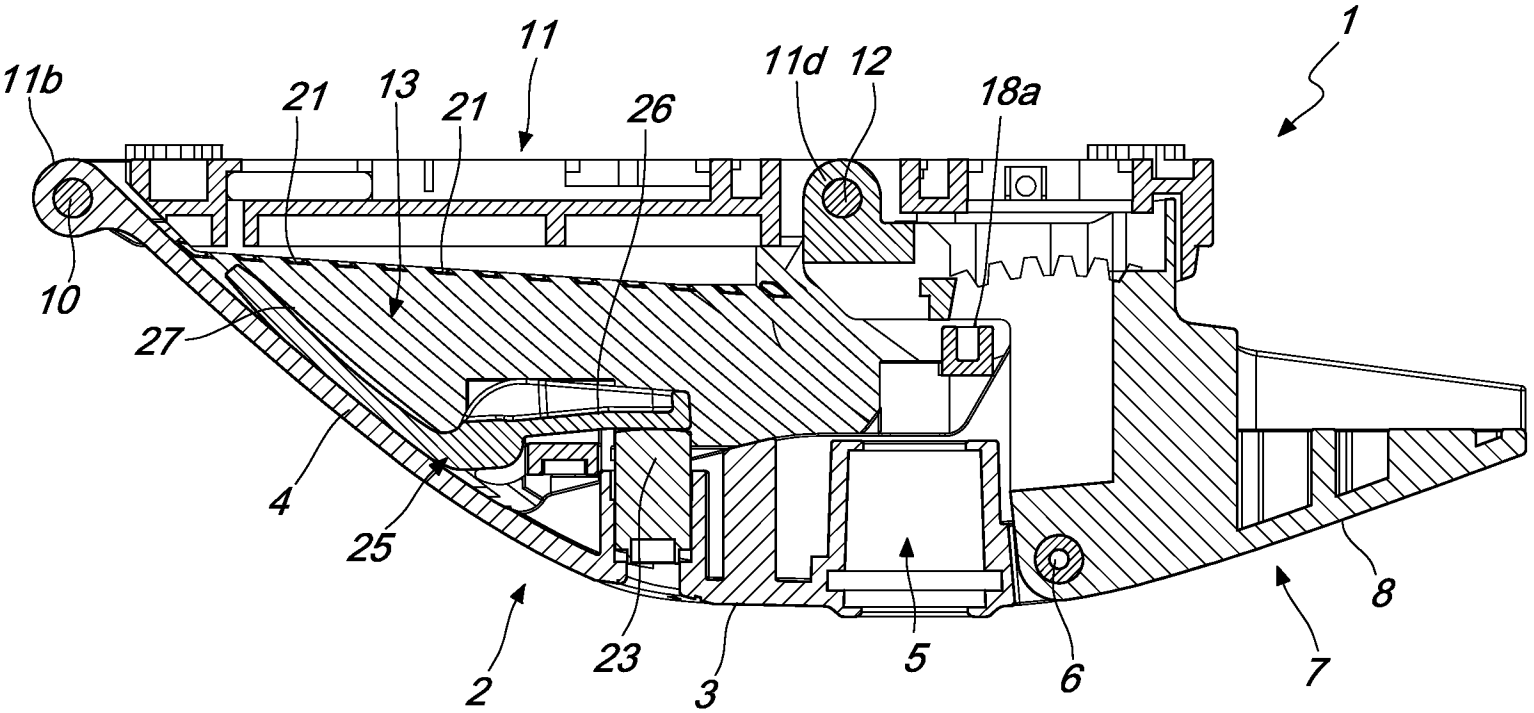
FIG. 14 is a cross-sectional view of the device according to the present invention taken along the line XIV-XIV of FIG. 6 wherein the second wing of the first plate is in the condition in which it is under load.

The total length of the two packs of leaf springs 13*a*, 13*b* and the dimension of the bases 15*a*, 15*b* are such as to allow their positioning in the interspace that is present between the first plate 2 and the third plate 11, the free ends 16 of the at least one slat or leaf spring 13 being free to flex in the interspace that is present between the first plate 2 and the third plate 11 in the direction of the second plate 7, as shown in FIG. 12.

These bases 15*a*, 15*b* have a front end 17*a*, 17*b* which is positioned and associated, in abutment, at the first slots 6*b*.

Each one of the bases 15*a*, 15*b* furthermore has, in the region from which the slats or leaf springs 13*a*, 13*b* extend, transverse first teeth 30*a*, 30*b* for coupling to said bases 15*a*, 15*b*.

Advantageously, the bases 15*a*, 15*b* are connected transversely to each other, proximate to their ends, by bridges 18*a*, 18*b* which are adapted to strengthen them.

The means for connection to the at least one slat or leaf spring 13 are constituted by two sliders 19*a*, 19*b* which can be arranged at an adapted groove 20*a*, 20*b* which is provided axially at the free end of each one of the at least one slat or leaf spring 13.

Each one of the sliders 19*a*, 19*b* is provided transversely with second teeth 21, which protrude therefrom and are arranged, when installed, between two adjacent free ends 16 of each one of the two packs of slats or leaf springs 13*a*, 13*b*.

The sliders 19*a*, 19*b* have, at least proximate to the end that is adjacent to the second wing 4, at least one second tooth 21 which is arranged in abutment against a protrusion 22 which lies above it and protrudes from the second wing 4 in the direction of the second plate 7.

An inclination of the second plate 7, and therefore when the backrest of the chair is inclined because the user leans on it, is followed by a movement of the second wing 4 of the first plate 2 and of the third plate 11: in this way the second teeth 21 of the sliders 19*a*, 19*b* are moved so as to be contrasted, in their movement, by the two packs of slats or leaf springs 13*a*, 13*b* which are flexed elastically and therefore loaded, thus contrasting the inclination and allowing the automatic repositioning of the backrest once the leaning against the backrest has ceased.

The means for adjusting the inclination of the second wing 4 are associated with the third wing 3 of the first plate 2, such means being constituted by a screw 23 which is rotatably associated at a complementarily-threaded bushing 24 which protrudes internally from the third wing 3 and the head of which interacts with a lever 25.

The latter is L-shaped so as to define a fifth wing 26 and a sixth wing 27, the fifth wing 26 being pivoted, by means of a pair of pivots 28*a*, 28*b* that protrude laterally therefrom, to a pair of supports 29*a*, 29*b* which are present in the bridge 18*b* located proximate to the second wing 4.

The lever 25 rests on the bridge 18*b*.

It is thus possible to limit the oscillation of the second wing 4 of the first plate 2 as a function of the requirements of the user.

Thus it has been found that the adjustment device according to the invention fully achieves the intended aim and objects, since an adjustment device is obtained for a chair provided with an oscillating mechanism that makes it possible to reduce the overall number of parts inside it and at the same time to require less time for assembly of the parts and a saving in the investments relating to the construction of equipment for assembling thee device of the invention.

The possibility of using components made of plastic material makes it possible to provide manufactured articles that can in every way meet the technical characteristics of metallic components, so achieving a major improvement in the aesthetic factor which could not be obtained with traditional structures.

The use of a slat or leaf spring also means that the tension can be adjusted intuitively, with the functionality and perception being optimal for the user.

Furthermore, the use of a slat or leaf spring makes it possible to obtain a customization for different designs in that, precisely because it is made of plastic, it makes it possible, with lower investment costs, to adapt the final part to different types of backrests, therefore benefiting from an aesthetic flexibility that cannot be obtained with traditional and known metal bars.

The device can be installed on common seats or on customized seats indifferently, and is structurally simple as it has only three rotation fulcrums.

The possibility of manually adjusting from outside the flexibility and therefore the inclination of the elastically-deformable second wing 4 with respect to the first wing 3 makes it possible to rapidly and easily adapt the degree of oscillation as a function of the requirements of each individual user.

Lastly, the device has three rotation fulcrums, constituted by the first pivot 6, the second pivot 10 and the third pivot 12, which enable a simplification of structure and of actuation.

Naturally the materials used as well as the dimensions constituting the individual components of the invention may be more relevant according to the specific requirements.

The characteristics indicated as advantageous, advisable or similar, may also be lacking or be substituted by equivalent characteristics.

The disclosures in Italian Patent Application No. 102022000009566 from which this application claims priority are incorporated herein by reference.

What is claimed is:

1. An adjustment device for a chair, comprising an oscillating mechanism composed of a first plate, connected to a central gas-operated post for height adjustment of a seat, to which a second plate, fixed to a backrest, is articulated so that the second plate oscillates by means of a first pivot, wherein a third plate is articulated and interposed, respectively, by means of a second pivot and a third pivot, between said first plate and said second plate, and is configured to be connected to said seat, said first plate having means for connection to at least one slat or leaf spring which is adapted to act against an inclination of said second plate with respect to said first plate, wherein said first plate, which is substantially L-shaped, has a first wing, which is flat and to which said central post is connected, and a second wing, which is elastically deformable and interacts with means for adjusting inclination thereof with respect to said first wing.

2. The device according to claim 1, wherein said second plate is articulated transversely to a terminal end of said first wing and is also substantially L-shaped so as to define a third wing and a fourth wing, an articulation between said terminal end of said first wing occurring substantially at a point of connection of said third wing and said fourth wing by means of said first pivot arranged at first receptacles which are provided at first slots which are present on free ends of said first wing and at a point of connection of said third wing and said fourth wing of said second plate, said backrest being configured to be connected to said third wing.

3. The device according to claim 2, wherein said third plate is articulated so that the third plate oscillates at a free end of said second wing, by means of a second pivot which is arranged at second receptacles which are provided at second slots which are present on free ends of said second wing and said third plate, said seat being configured to be connected above said third plate.

4. The device according to claim 3, wherein said third plate is articulated, proximate to an end that is opposite to an end for articulation to said second wing, at a free end of said fourth wing of said second plate by means of the third pivot which is arranged at third receptacles which are provided at partitions and third slots which are present on said third plate and on a free end of said fourth wing of said second plate.

5. The device according to claim 2, wherein said connection means are constituted by two packs of slats or leaf springs, each one made of elastically deformable material, such as plastic material or metal, each one of said two packs of leaf springs being constituted by single slats or flat springs which are arranged, when inactive, parallel to each other along a plane that is substantially parallel to a plane of arrangement of said second wing, said two packs of slats or leaf springs being arranged parallel to each other proximate to lateral perimetral edges of said second wing and being connected in a lower region by two linear and rigid bases, which are configured to be positioned on said lateral perimetral edge of said first wing.

6. The device according to claim 5, wherein a total length of said two packs of leaf springs and a dimension of said bases are such as to allow positioning thereof in an interspace that is present between said first plate and said third plate, free ends of said at least one slat or leaf spring being free to flex in an interspace that is present between said first plate and said third plate in a direction of said second plate.

7. The device according to claim 5, wherein said bases have a front end that is positioned and connected at said first slots, said bases being connected transversely to each other, proximate to ends thereof, by bridges which are adapted to strengthen said bases, each one of said bases having, in a region from which said slats or leaf springs extend, transverse first teeth for coupling to said bases.

8. The device according to claim 7, wherein said connection means for connection to said at least one slat or leaf spring are constituted by two sliders which are configured to be arranged at a groove which is provided axially at a free end of each one of said at least one slat or leaf spring, each one of said sliders being provided transversely with second teeth, which protrude therefrom and are arranged, when installed, between two adjacent said slats or leaf springs of each one of said two packs of slats or leaf springs, said sliders having, at least proximate to an end that is adjacent to said second wing, at least one of said second teeth which is arranged in abutment against a protrusion which lies above the protrusion and protrudes from said second wing in a direction of said second plate.

9. The device according to claim 8, wherein an inclination of said second plate, and therefore when said backrest of said chair is inclined, is followed by a movement of said second wing of said first plate and of said third plate so that said second teeth of said sliders are moved against said two packs of slats or leaf springs which are flexed elastically and therefore loaded, thus acting against the inclination and allowing an automatic repositioning of the backrest once leaning against the backrest has ceased.

10. The device according to claim 2, wherein means for adjusting the inclination of said second wing interacts with said third wing of said first plate, and is constituted by a screw which is rotatably connected at a complementarily-threaded bushing which protrudes internally from said third wing and a head of which interacts with a lever which is L-shaped so as to define a fifth wing and a sixth wing, said fifth wing being pivoted, by means of a pair of pivots that protrude laterally therefrom, to a pair of supports which are present in a bridge located proximate to said second wing, said lever resting on said bridge.

* * * * *